US008534011B2

(12) United States Patent
Andres

(10) Patent No.: US 8,534,011 B2
(45) Date of Patent: Sep. 17, 2013

(54) WINDOW AND DOOR FRAME ASSEMBLY APPARATUS AND METHOD

(76) Inventor: Craig E. Andres, Danville, CA (US)

( * ) Notice: Subject to any disclaimer, the term of this patent is extended or adjusted under 35 U.S.C. 154(b) by 0 days.

(21) Appl. No.: 13/084,358

(22) Filed: Apr. 11, 2011

(65) Prior Publication Data

US 2011/0185653 A1 Aug. 4, 2011

Related U.S. Application Data

(62) Division of application No. 11/838,182, filed on Aug. 13, 2007, now Pat. No. 8,104,241.

(51) Int. Cl.
*E06B 3/30* (2006.01)

(52) U.S. Cl.
USPC ..... 52/204.53; 52/211; 52/208; 52/215

(58) Field of Classification Search
USPC ..... 52/208, 204.53, 215, 211
See application file for complete search history.

(56) References Cited

U.S. PATENT DOCUMENTS 3,760,543 A * 9/1973 McAllister ..... 52/204.591
3,881,290 A * 5/1975 Bouchey ..... 52/204.593
3,975,875 A 8/1976 Goss, Jr.
4,076,439 A 2/1978 Sakashita
4,193,238 A 3/1980 Chalmers et al.
4,272,931 A 6/1981 Stanizzo
4,327,535 A * 5/1982 Governale ..... 52/309.11
4,389,824 A 6/1983 Anderson
4,391,072 A 7/1983 Moore
4,811,533 A 3/1989 Wetsel
4,858,405 A 8/1989 Christie
4,972,640 A 11/1990 DiFazio
5,105,597 A * 4/1992 Wilkening ..... 52/455
5,133,168 A * 7/1992 Neilly et al. ..... 52/204.5
5,134,814 A 8/1992 Hauser
5,220,756 A 6/1993 Hauser
5,233,802 A * 8/1993 Rogers ..... 52/212
5,348,066 A 9/1994 Wilson
5,437,130 A * 8/1995 Raynak ..... 52/210
5,485,705 A 1/1996 Guillemet
5,625,992 A 5/1997 Strick et al.
5,644,881 A * 7/1997 Neilly ..... 52/455
5,669,192 A 9/1997 Opdyke et al.
5,758,458 A 6/1998 Ridge
5,836,119 A * 11/1998 Emmanuel ..... 52/204.71

(Continued)

*Primary Examiner* — William Gilbert
*Assistant Examiner* — Alp Akbasli
(74) *Attorney, Agent, or Firm* — Nixon Peabody LLP

(57) ABSTRACT

Pre-fabricated kits are provided for window/door trimming/casing that are designed and tailored for various window/door openings, architectural styles and/or manufacturers. According to one aspect, the kit is easy to assemble with everything in the box including prefabricated mutually engaging fasteners to allow all the pieces to be fastened together quickly and by hand. According to another aspect, the kit is prefabricated in a prepared and finished condition with all the pieces already painted, stained and finished, so no finishing such as painting required during or after installation. The kit can be manufactured to fit for any type of window/door and opening as long as the dimensions of openings are substantially known. Optional add-ons such as curtain rods, valances, closet shelves, poles, cabinets, shutters and cornices can also be included in the kit in pre-fabricated condition. The principles of the invention can also be extended to other types of molding such as crown molding and baseboards. Among many advantages, the invention reduces labor costs dramatically, improves quality and consistency in craftsmanship, and provides economies of scale to be applied the production of finished products that has never been previously available.

15 Claims, 16 Drawing Sheets

(56) References Cited

U.S. PATENT DOCUMENTS

| | | | | |
|---|---|---|---|---|
| 5,857,299 | A | 1/1999 | Gyllenberg et al. | |
| 5,941,033 | A | 8/1999 | Adams | |
| 5,941,046 | A | 8/1999 | Prather | |
| 5,974,745 | A | 11/1999 | Barr | |
| 6,082,674 | A | 7/2000 | White | |
| 6,125,605 | A * | 10/2000 | Young | 52/717.01 |
| 6,141,925 | A | 11/2000 | Halvorson et al. | |
| 6,148,584 | A | 11/2000 | Wilson | |
| 6,148,883 | A | 11/2000 | Wilson | |
| 6,173,542 | B1 | 1/2001 | Wright | |
| 6,389,763 | B1 | 5/2002 | Clauss | |
| 6,553,735 | B1 * | 4/2003 | Wang Chen | 52/455 |
| 6,560,944 | B1 | 5/2003 | Wilson | |
| 6,619,005 | B1 * | 9/2003 | Chen | 52/455 |
| D481,803 | S | 11/2003 | Gordon et al. | |
| 6,694,701 | B2 | 2/2004 | Wang et al. | |
| D493,234 | S | 7/2004 | Vastine | |
| 6,807,778 | B2 | 10/2004 | Engebretson | |
| 6,829,865 | B2 | 12/2004 | Smith | |
| 6,857,232 | B2 | 2/2005 | Bealko | |
| 7,010,888 | B2 | 3/2006 | Tumlin | |
| 7,086,206 | B2 | 8/2006 | Wang et al. | |
| 7,284,353 | B2 * | 10/2007 | Bealko | 52/656.5 |
| 7,331,142 | B2 * | 2/2008 | Gerard | 49/505 |
| 7,454,865 | B2 | 11/2008 | Kerscher | |
| 7,788,862 | B2 * | 9/2010 | Wang et al. | 52/205 |
| 2001/0034985 | A1 * | 11/2001 | Schweikart | 52/204.5 |
| 2004/0068942 | A1 * | 4/2004 | Krochmal et al. | 52/204.71 |
| 2004/0187408 | A1 | 9/2004 | Smith | |
| 2005/0050815 | A1 | 3/2005 | Engebretson | |
| 2005/0115168 | A1 | 6/2005 | Bealko | |
| 2005/0193654 | A1 | 9/2005 | Primozich | |
| 2005/0262782 | A1 | 12/2005 | Harrison et al. | |
| 2006/0107608 | A1 * | 5/2006 | Mirau | 52/211 |
| 2006/0207197 | A1 | 9/2006 | Anderson | |
| 2006/0254201 | A1 | 11/2006 | Pittman | |

* cited by examiner

WINDOW AND DOOR FRAME ASSEMBLY APPARATUS AND METHOD

CROSS-REFERENCE TO RELATED APPLICATIONS

This application is a divisional of U.S. application Ser. No. 11/838,182 filed Aug. 13, 2007, the contents of which are hereby incorporated by reference in its entirety.

FIELD OF THE INVENTION

The present invention relates generally to windows, doors, and similar structures for buildings such as homes and offices, and more particularly to a prefabricated assembly for trimming/casing such structures and a methodology for the same.

BACKGROUND OF THE INVENTION

In conventional housing construction (e.g. single and multifamily homes, apartments, condominiums, townhouses), windows and doors are typically installed and trimmed manually that involves many labor-intensive steps. For example, installing and trimming a window requires, at least: sizing a window opening, installing the window in the opening, measuring the window surroundings and casing materials, manually cutting trim pieces at proper angles to proper length according to the measurements, fitting pieces around the wall opening, adding and securing pieces to the surrounding wall with nails, and painting/staining the window trim. Such a manual process requires several different skilled personnel (e.g. window installer, window trimmer and painter), costs long labor hours and material waste, and the quality of final product varies upon the skill and proficiency of the handicraftsman(s).

Some attempts at pre-fabricated window assemblies have been made. U.S. Pat. No. 6,389,763 describes grooves and tongues allowing for variation in fitting the gaps between wall and jamb, but the jamb and window trim assembly are pre-assembled, which complicates shipping, and materials must be nailed to a wall. U.S. Pat. No. 4,193,238 describes brackets installed along a window cases allowing window casing cover to snap on around an opening, but the brackets require screws for installation. U.S. Pat. No. 4,972,640 describes attaching a window trim assembly to a window frame using mounting clips, but the window surrounding is pre-assembled. U.S. Pat. Nos. 5,134,814 and 5,220,756 teach a prefabricated window stool and apron unit for window enhancement, but the installation requires screws to fasten the unit to wall. U.S. Pat. No. 5,348,066 also teaches a wood trim system with pre-finished window trim and nails/screws are required. U.S. Pat. No. 5,941,033 describes a vinyl window finish trim assembly for mounting in a window opening, however this patent requires an extrusion fitting within the window and separately attached corner pieces to secure the trim pieces together, thus limiting the types of windows and openings in which it is used. Similar drawbacks are found in U.S. Pat. No. 6,857,232 and U.S. Publication No. 2005/0115168 where nails/screws are required to fasten the trim casing. Another similar method is taught in U.S. Publication No. 2006/0254201 where pieces are custom made but must be pre-assembled prior to delivery, again complicating shipping.

It remains desirable for an easy, efficient and inexpensive way to trim a window or other opening with high quality and predictable results.

SUMMARY OF THE INVENTION

The present invention broadly contemplates the provision of pre-fabricated kits for window/door trimming/casing that are designed and tailored for various window/door openings, architectural styles and/or manufacturers. According to one aspect, the kit is easy to assemble with everything in the box including prefabricated mutually engaging fasteners to allow all the pieces to be fastened together quickly and by hand. According to another aspect, the kit is prefabricated in a prepared and finished condition with all the pieces already painted, stained and finished, so no finishing such as painting required during or after installation. The kit can be manufactured to fit for any type of window/door and opening as long as the dimensions of openings are substantially known. Optional add-ons such as curtain rods, valances, closet shelves, poles, cabinets, shutters and cornices can also be included in the kit in pre-fabricated condition. The principles of the invention can also be extended to other types of molding such as crown molding and baseboards. Among many advantages, the invention reduces labor costs dramatically, improves quality and consistency in craftsmanship, and provides economies of scale to be applied the production of finished products that has never been previously available.

According to these and other aspects, a kit for framing an opening in a building comprises all pieces needed for the frame, precut and pre-finished for the opening, wherein all the pieces can be assembled together in the opening by hand and held together with a friction fit.

BRIEF DESCRIPTION OF THE DRAWINGS

These and other aspects and features of the present invention will become apparent to those ordinarily skilled in the art upon review of the following description of specific embodiments of the invention in conjunction with the accompanying figures, wherein.

DETAILED DESCRIPTION OF THE PREFERRED EMBODIMENTS

The present invention will now be described in detail with reference to the drawings, which are provided as illustrative examples of the invention so as to enable those skilled in the art to practice the invention. Notably, the figures and examples below are not meant to limit the scope of the present invention to a single embodiment, but other embodiments are possible by way of interchange of some or all of the described or illustrated elements. Moreover, where certain elements of the present invention can be partially or fully implemented using known components, only those portions of such known components that are necessary for an understanding of the present invention will be described, and detailed descriptions of other portions of such known components will be omitted so as not to obscure the invention. In the present specification, an embodiment showing a singular component should not be considered limiting; rather, the invention is intended to encompass other embodiments including a plurality of the same component, and vice-versa, unless explicitly stated otherwise herein. Moreover, applicants do not intend for any term in the specification or claims to be ascribed an uncommon or special meaning unless explicitly set forth as such. Further, the present invention encompasses present and future known equivalents to the known components referred to herein by way of illustration.

Figure 1:
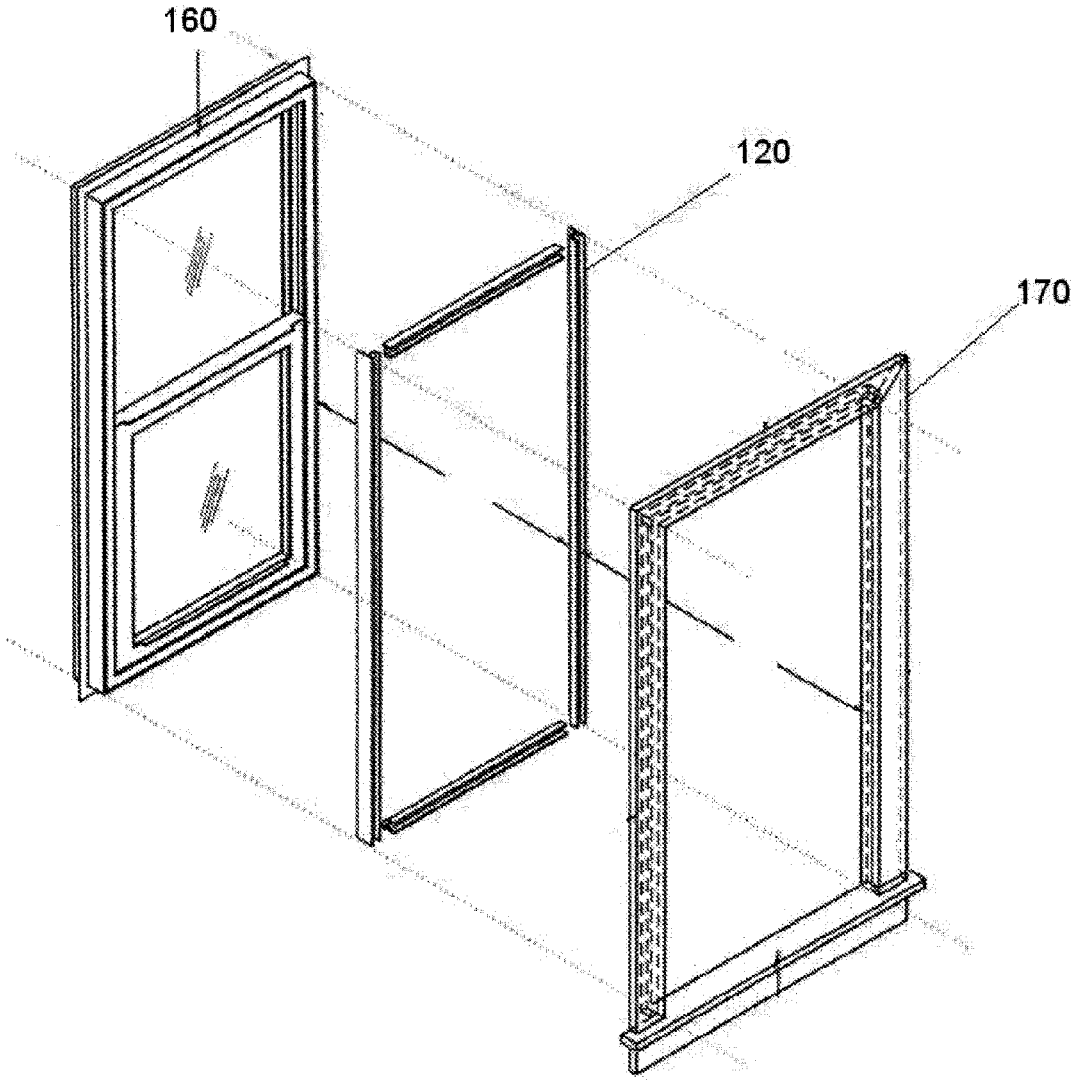
FIG. 1 is an exploded view of one example of a prefabricated window trim kit installed to a window according to aspects of the invention.

According to a first aspect, the invention provides prefabricated kits for various window openings and manufacturers. FIG. 1 shows the exploded view of a window frame kit 170 installed onto a typical double-hung window 160. The example window 160 shown in FIG. 1 is a 200 Series Double-Hung window from Andersen Corp. of Bayport, Minn., measuring 1' 11½" by 4' 5½". It should be noted that the invention is not limited to this example size, type or manufacturer. Rather, it is an aspect of the invention that the window 160 can be of any type and size and can have fixed panes, horizontal sliding, or vertical sliding sashes as indicated symbolically by window 160. Some other non-limiting examples of possible types of window 160 include gliding window, awning window, casement window, and skylights, etc. Still further, while the invention will be described as trimming a window or opening, other substantially synonymous terms of art include casing and molding.

In the example shown in FIG. 1, frame kit 170, after being assembled as described in more detail below, is secured to window 160 and the corresponding window opening by directly snapping the kit 170 into the window perimeter slot 120, which further snap-fits into window 160. Various window perimeter slots 120 can be available for many types of windows and are designed and manufactured by several vendors, such as EZ Trim Kit of Danville, Calif. or Veka, Inc. of Frombell, Pa. Other alternative ways of securing the frame kit 170 to window 160, such as using adhesive instead of slots 120, will be apparent from the descriptions and examples provided herein, and these are to be included in the spirit of the present invention. More detailed descriptions will be given later in this disclosure.

One example embodiment of a window trim assembly 170 according to the principles of the invention will now be described in more detail in connection with the front, rear, and side views shown in FIGS. 2 and 3. As shown, this example window trim assembly 160 includes head trim 210, a pair of side trim 220, sill trim 230, apron trim 240, a pair of jamb extenders 250, and head jamb extender 260. According to aspects of the invention to be described in more detail below, the dimensions of head trim 210, side trim 220, sill trim 230, apron trim 240, jamb extenders 250 and head jamb extender 260 are pre-determined in accordance with the size of the opening and the type of window and manufacturer. Moreover, although not shown in detail in the drawings, the pieces can be machined with ornamental features (e.g. for the trim pieces) and honches (e.g. for the apron and sill).

According to one preferred example of the invention using dowels as described in more detail below, the components are all comprised of wood such as poplar. However, the invention is not limited to this example, and various other types of wood such as, by way of non-limiting example, oak, cherry, pine, black walnut, ash, MDF, maple, fir. Moreover, other non-wood materials can be used for manufacturing the pieces, such as vinyl, polystyrene, etc., as should be apparent to those of ordinary skill in the art, and these are to be included in the spirit of the present invention. Moreover, it is not necessary for all components in the kit 170 to be comprised of the same material. For example, some components in the kit may be comprised of wood, while other components may be comprised of vinyl.

Returning to the particular example shown in FIG. 1, with a standard rough window opening of 2' 0" by 4' 6", and a 200 Series Double-Hung window, head trim 210 is an isosceles-trapezoid shape piece with two shorter and longer legs approx. 22" and 30" respectively, a width of about 3½" and a thickness of approx ¾". Profile 220 is in this case is a right-trapezoid shape piece with the longer leg 4' 8", the shorter leg 4' 4", about 3½" wide and a thickness of about ¾". Sill trim 230 is in this case is a rectangular piece with dimensions of about 2' 7" by 3" and about ¾" thick. Apron trim 240 is in this case a rectangular piece with dimensions of 2' 5" by 3½" and about ¾" thick. A jamb extender 250, with width depending on thickness of the wall, is in this case a rectangular piece with dimensions of about 4' 4" by 1¾" and about ¾" thick. The head jamb extender 260 is in this case a rectangular piece with dimensions of about 2' by 1¾" and about ¾" thick, and also has a width depending on thickness of the wall, as will become more apparent from the descriptions below.

In this illustrated example, head trim 210 and profile 220 are in trapezoid shapes so that they form a ninety degree angle when assembled. However, this is not necessary. Moreover, the final shape of the trim after putting all pieces together will be rectangular in this case, which again, is for illustration purposes in connection with the rectangular window opening, but the spirit of the present invention will not be limited to specifications herein. According to aspects of the invention, two matching pairs of multi-fluted wood dowels and holes 270, with 5/16 inch diameter and 1 inch in length, are located on each upper corner of the trim at where the head trim 210 and the profiles 220 join together, so that they are tightly attached with a friction fit when the dowels are inserted in the holes and the pieces are pushed together. Similar matching dowels and holes 290 join together profiles 220 to jamb extenders 250. Likewise, matching dowels and holes 280 join together profiles 220 with sill trim 230; matching dowels and holes 211 join together apron trim 240 and sill trim 230; and matching dowels and holes 201 join together head trim 210 and head jamb extender 260.

Figure 2:
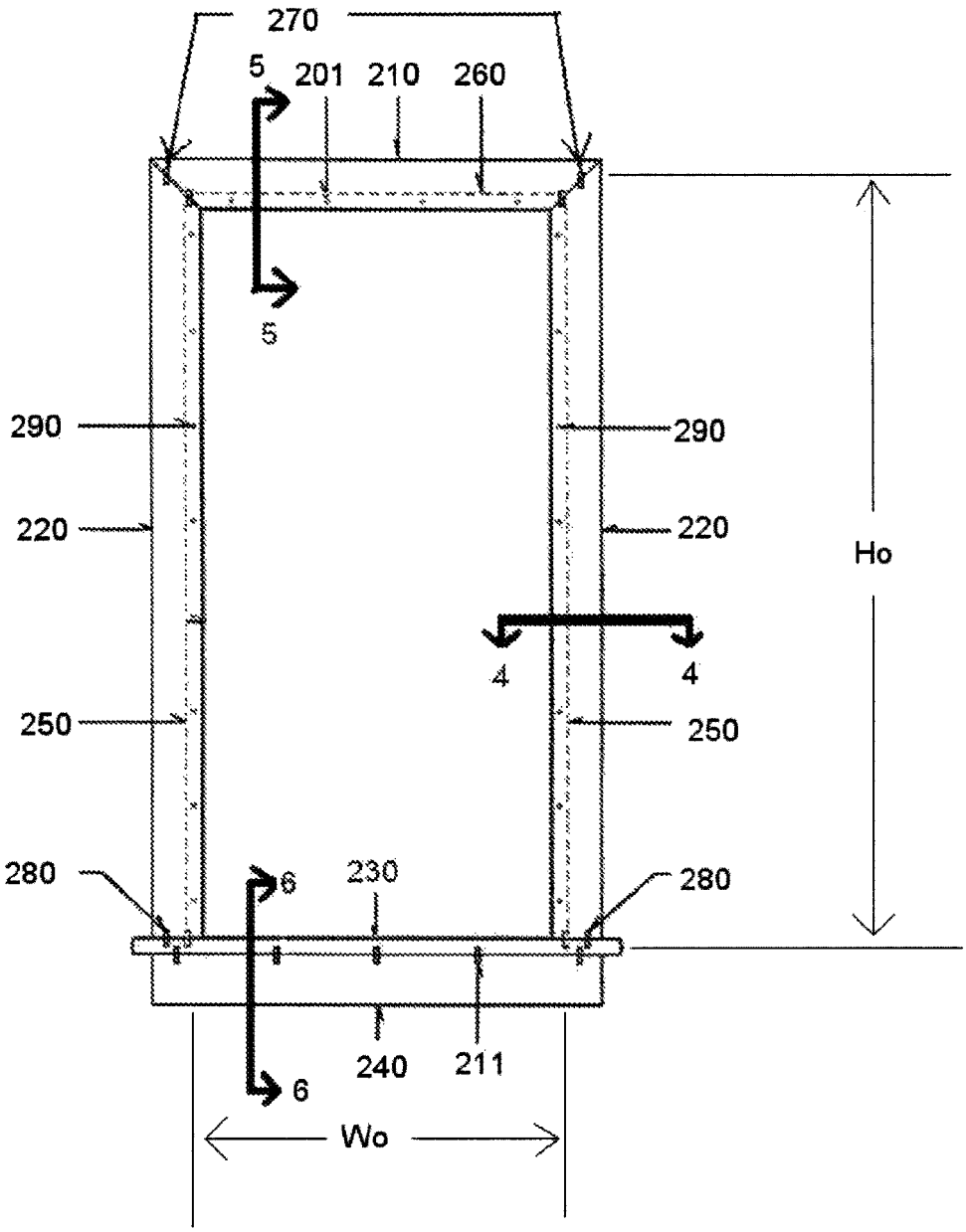
FIG. 2 is a front view of the assembled window trim shown in FIG. 1.

In the example shown in FIG. 2, matching pairs of dowels and holes 201, 290 and 211 are spaced at most about 4½ inches apart, and located on the touching sides of both pieces. For example, if profiles 220 and jamb extender 250 are about 50 inches long, there will be approximately eight matching pairs of holes and dowels, with all holes located on one piece, and all dowels located on the other. Meanwhile, as shown in the example of FIG. 2 only two pairs of matching holes and dowels 270 and 280 are provided on facing surfaces that are only a few inches long, which is sufficient in this example.

In one example embodiment, the number and tightness of the friction fit between the holes and dowels is sufficient to maintain the overall structural integrity of the assembled structure. In other embodiments, for further integrity, dovetail fasteners may be used instead or added for field assembly of kit 170 as described in more detail below.

Figure 9:
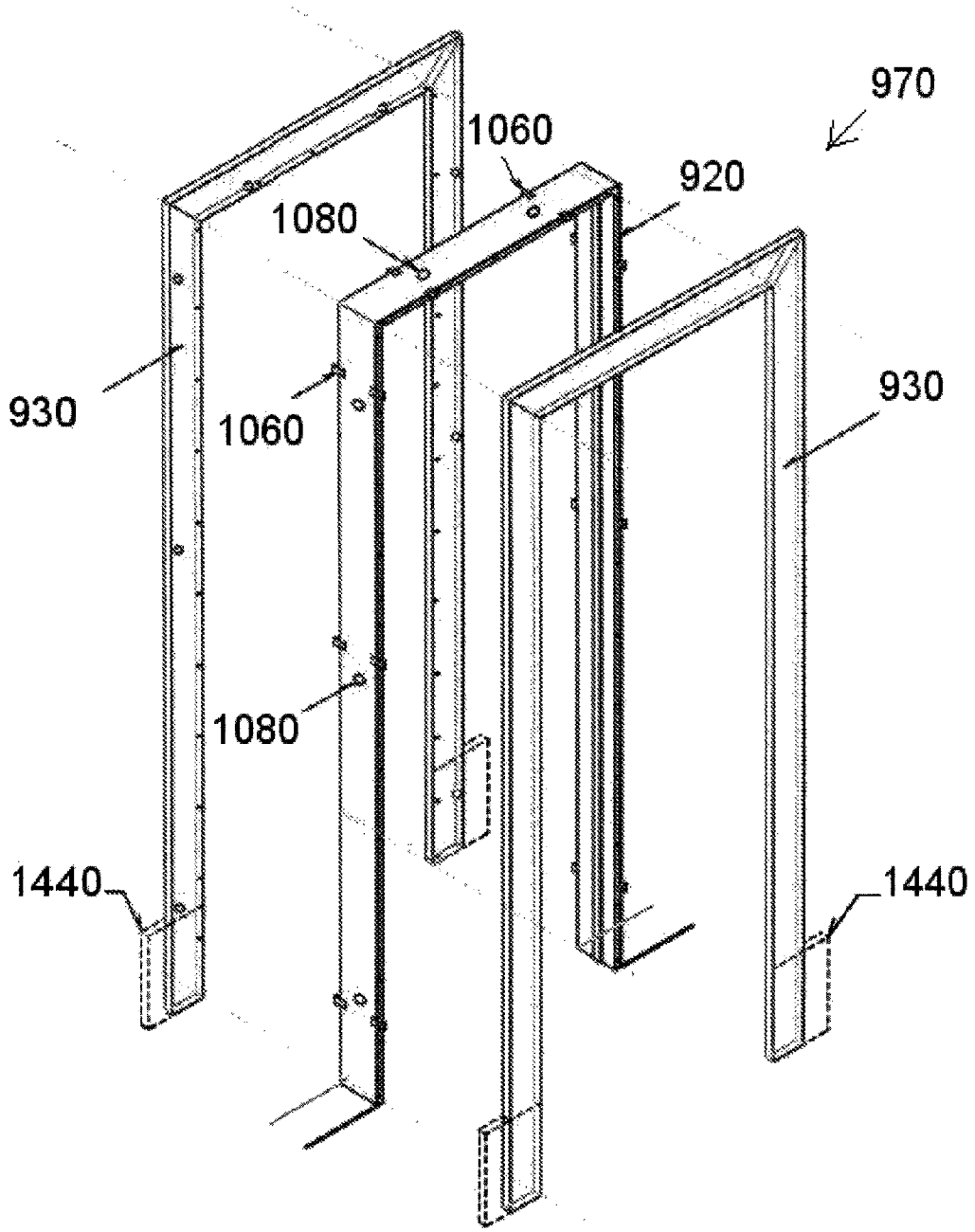
FIG. 9 is an exploded view of another example of a prefabricated window trim kit installed to a door according to aspects of the invention.

As mentioned above, the principles of the invention are not limited to window openings. For example, the present invention can also be applied to a door opening. In another example of the present invention shown in the exploded view in FIG. 9, a door frame kit 970, after being assembled, is secured to a door opening and the corresponding existing door frame 960 by securing the door jamb 920 inside an existing door frame 960 and attaching the door casings 930 to each side of the door jamb 920. Other alternative ways of securing the frame kit 970 to door opening 960 will be apparent from the descriptions and examples provided herein, and these are to be included in the spirit of the present invention.

The door frame kit 970 is another example embodiment according to the principles of the invention and will now be described in more detail in connection with the detailed front view shown in FIG. 10. As shown, the two door casings 930 in this example are the same, but it should be readily understood that they can be different. In this example, both casings 930 include a head trim 1010 and a pair of profiles 1020, where the door jamb 920 includes a pair of side jambs 1030, and head jamb 1040. According to aspects of the invention to be described in more detail below, and similar to those described above for windows, the dimensions of head trim 1010, profiles 1020, side jambs 1030 and head jamb 1040 are pre-determined in accordance with the size of the opening and the type of door and manufacturer.

In this illustrated example, head trim 1010 and profile 1020 are in trapezoid shapes so that they form a ninety degree angle when assembled. However, this is not necessary. The final shape of this door assembly kit 970 after putting all pieces together will be rectangular looking from the front in this case, which again, is for illustration purposes in connection with the rectangular door opening, but the spirit of the present invention will not be limited to specifications herein.

In addition to the wood dowels and holes, as described above in the window example, additional assembly and securing methods can be used. For example, pairs of dovetail fasteners 1070 are shown here in addition to the dowels and holes pairs to join tighter the head trim 1010 and profile 1020 with still further friction fit. For example, the fasteners 1070 can be comprised of plastic and about ¼" thick and about ¾" long, as several types are known to those skilled in the art of cabinetry and similar trades (e.g. Hoffmans). Corresponding slots can be cut into trim 1010 and profile 1020 for accepting the fasteners. For assembly of the kit, after the pieces 1010 and 1020 are joined together using the dowels and holes, the slots in the respective pieces will align, and the fasteners 1070 can be pounded in using a mallet or similar tool. It should be noted that the dimensions of the slot should be slightly smaller than the dimensions of the dovetail fasteners so that they compress slightly when pounded into the slots, thereby securing the pieces 1010 and 1020 together.

Figure 11:
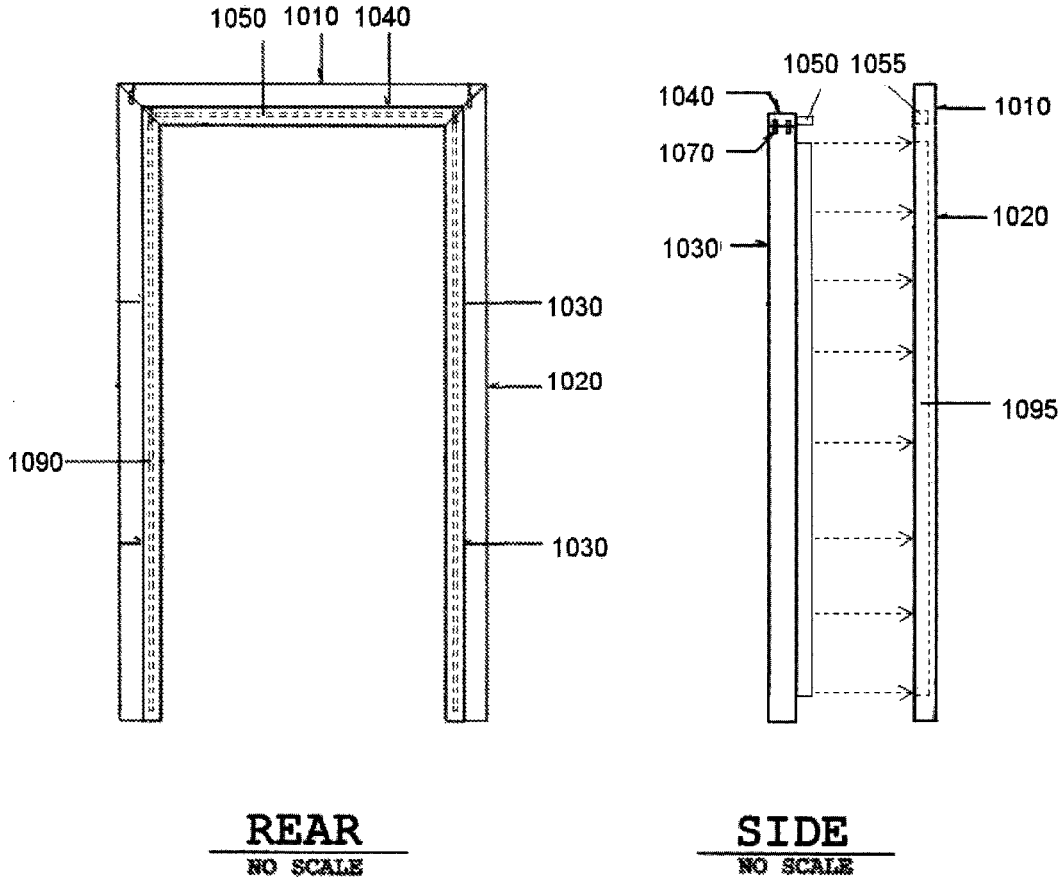
FIG. 11 is the rear and exploded-side view of the assembled door trim using grooves and tongues.

As an another possible alternative, matching pairs of grooves and tongues are also used for this assembling kit pieces together as shown in FIG. 11. In this illustrated example, a matching pair of groove 1095 and tongue 1090 with dimensions of about ¼" thick and ¾" deep are located on the touching sides of profiles 1020 and side jambs 1030 to join them together with a friction fit when the tongue 1090 are inserted into the groove 1095. Likewise, a matching tongue 1050 and groove 1055 join together head trim 1010 and head jamb 1040. In the example shown in FIG. 11, the length and width of the matching pairs of tongues and grooves 1050, 1055, 1090, 1095 are depending on the dimensions of the kit 970.

According to an aspect of the invention, whether holes and dowels, dovetail fasteners, and/or tongues and grooves are used, the invention allows the entire kit 170 to be assembled by hand, and the resulting assembly is secured with a friction fit, such that nails and other materials are not required to assemble window trim kit 170. It should be apparent, however, that glue or other compounds can be used in the holes before the dowels are inserted to even further secure the pieces together. Moreover, the number and size of matching dowel and hole pairs is a design choice and the examples described herein enable a desired amount of rigidity for the assembled structure while preserving ease of assembly.

Figure 12:
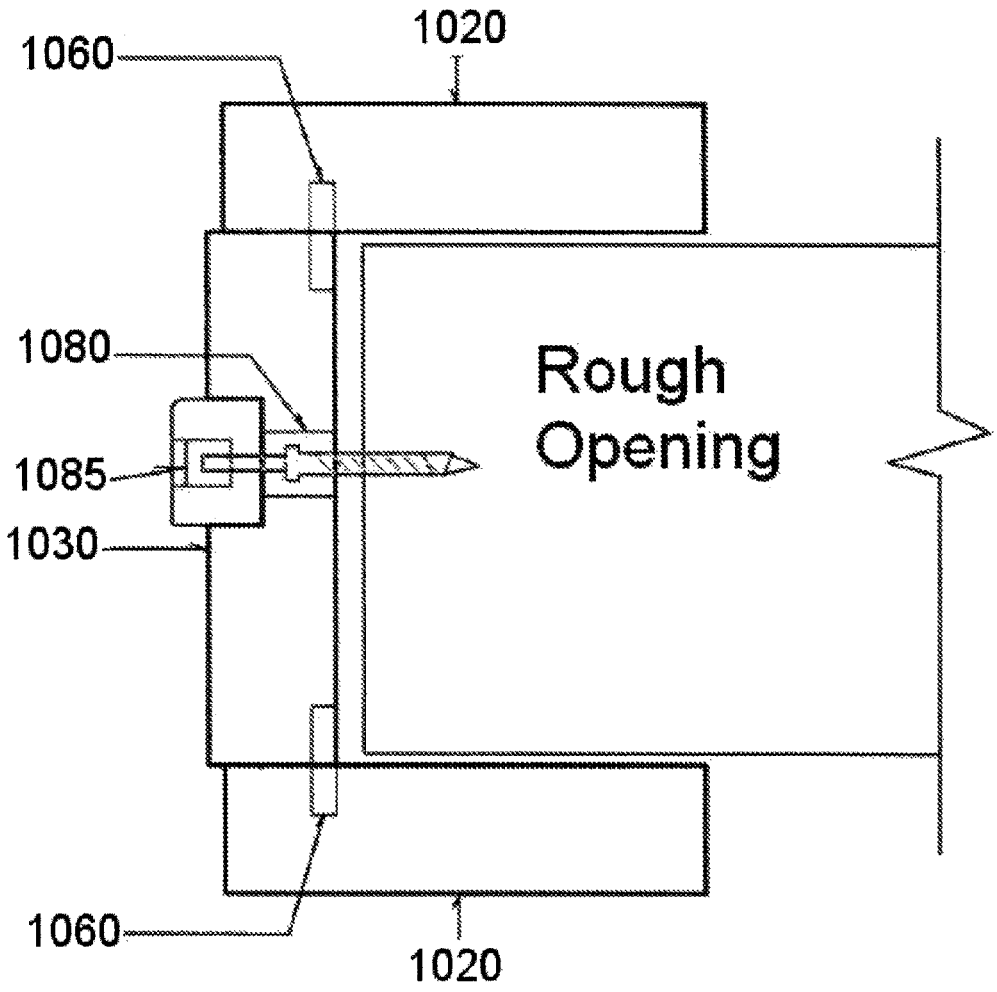
FIG. 12 is the enlarged top view of the middle cross section of the installed door trim kit shown in FIG. 9.

As further shown in FIG. 12, after assembling the two door casings 930 and assembling the door jamb 920, dovetails 1060 and pairs of dowels and holes are used, as described above, to attach the profiles 1020 of the two door casings 930 onto each side of the side piece 1030 of the door jamb to form trimmings around the door frame. As further shown in FIG. 12, jamb jacks 1080 are used in some embodiments of a door kit to secure a door jamb 920 to a rough opening. As further shown, a door stop 1085 can further be attached to door jamb 920 using dowels or screws. Door stop 1085 can be a separate wood piece about ½" thick and about ¾" wide and having a length about the same as the interior dimensions of the jamb 920. As further shown, a corresponding accepting notch can be formed in the interior of jamb 920, having a depth of only about ¼" so that the door stop extends further into the opening of frame 960. As further shown in FIG. 12, holes are drilled in piece 1030 to accept the screw of the jamb jack 1080.

Figure 13:
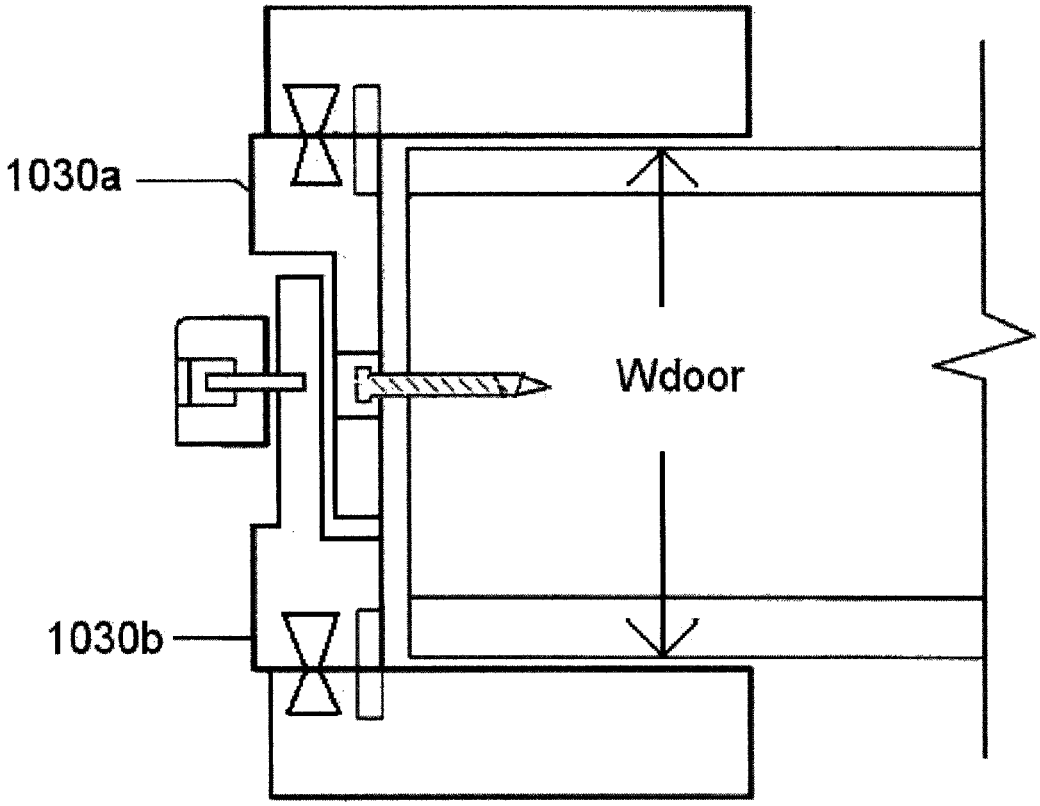
FIG. 13 is the enlarged top view of the middle cross section of an alternative of the installed door trim kit shown in FIG. 9.

It should be noted that piece 1030 of door jamb 920, as well as head jamb 1040 of jamb 920, have been described above as only comprising a single piece of wood or other material, it is possible that a split jamb approach can be used. For example, the two casings 930 can be joined to separate halves of jamb 920, which can be either secured to a rough door opening separately or further joined together. One possible example is shown in FIG. 13, where the jamb extender 1030 is split into two pieces 1030*a* and 1030*b* so that walls with various widths $W_{door}$ can be accommodated by adjusting the two pieces of jamb extenders 1030*a* and 1030*b* to fit the wall. Those skilled in the art will appreciate various additional alternatives.

Figure 10:
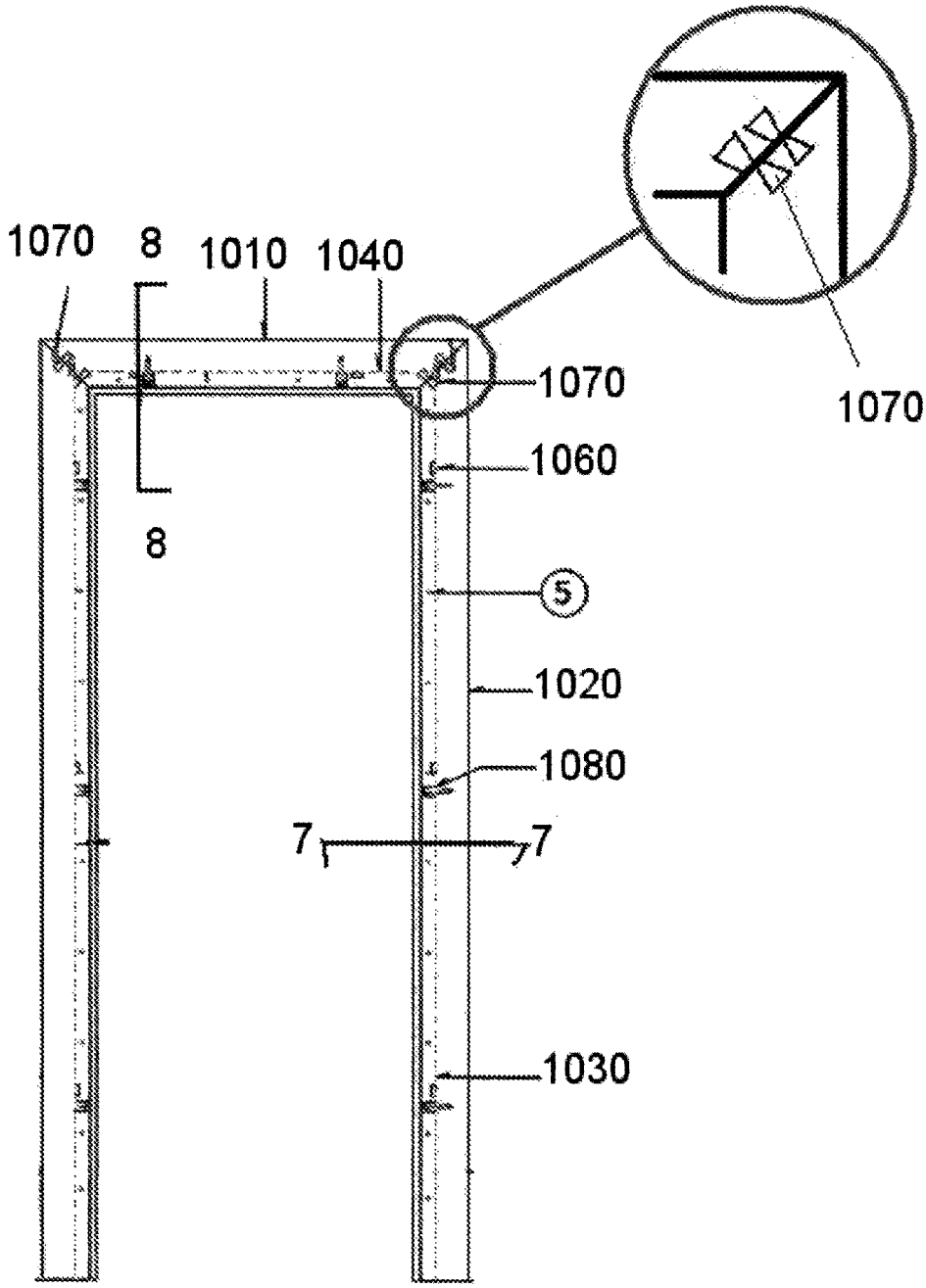
FIG. 10 is a front view of the assembled door trim shown in FIG. 9.
Figure 14:
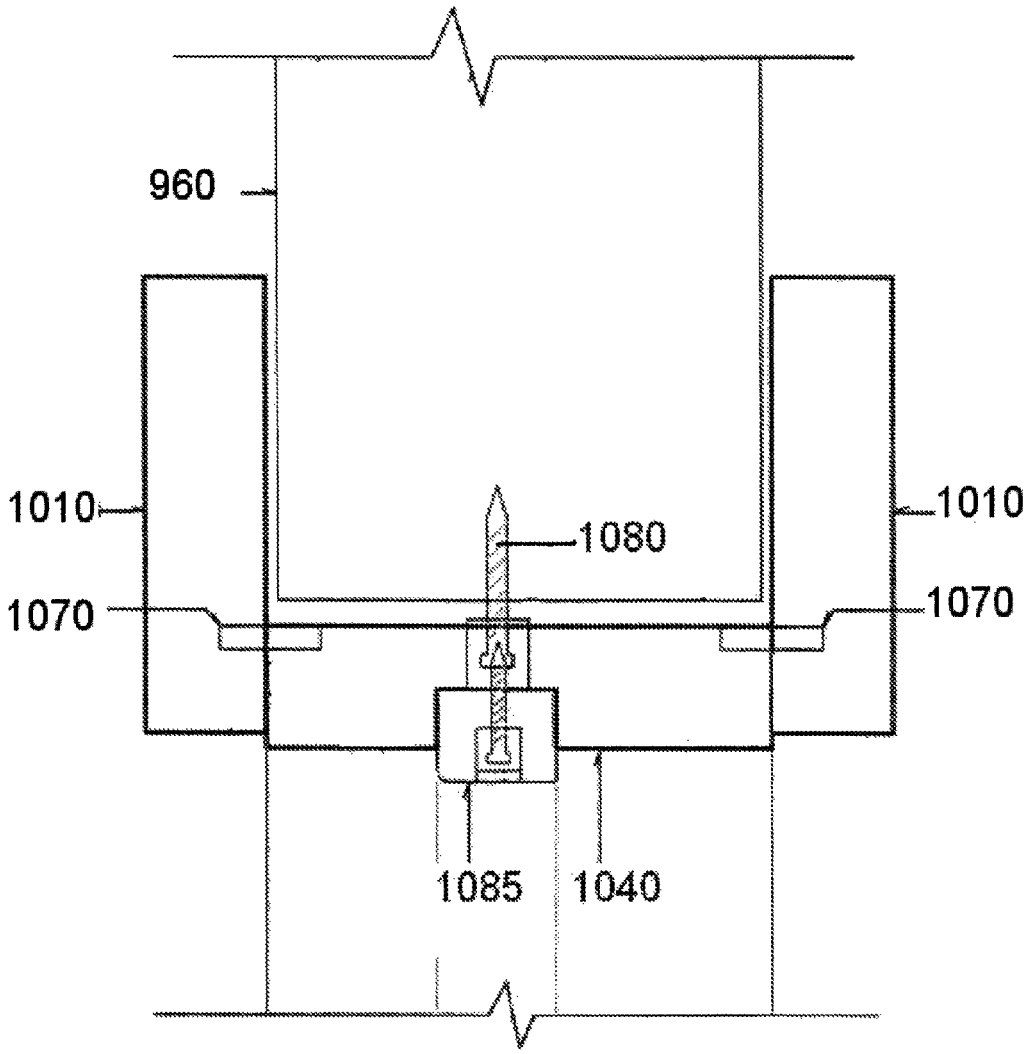
FIG. 14 is the enlarged side view of the upper-left corner of a installed door trim kit; shown in FIG. 9.

FIG. 14 shows an enlarged side view taken along cross-section 8-8 in FIG. 10. As shown, head trim 1010 is attached to the head jamb 1040 with dovetails 1070 in addition to dowels and holes. The head piece 1040 of jamb 920 is attached to the rough door opening with fasteners such as screws and nails.

As further mentioned previously, the kit 170 and kit 970 components, pieces dimensions, and trim shapes described above are tailored to fit for a double-hung window frame and a single door frame and are specifically discussed for illustration purpose. However, other components, dimensions, and shapes that serve the purpose of trimming or decorating an arbitrary opening will be apparent to those skilled in the art upon reading the present disclosure, and these are also to be included in the spirit of the present invention. For example, the assembled kit 170 can have a radius top to fit on a radius window, the kit 970 can be wider to fit on a 3-panel entry door, pieces dimensions will be bigger for a two-by-six window than for a two-by-four window, and extra components such as a curtain rod will be included if curtains are to be installed.

According to another aspect of the invention, and as mentioned above, the prefabricated kits 170 and 970 are easy to assemble on-site and can be secured in a window/door opening and/or to an installed window/door without requiring any additional carpentry or nails. Upon delivery, every piece of material needed for window trim is included in the kit, already cut to size, painted/stained to the desired color and/or finish, and prepared. Pieces are pre-cut for different window openings and window types so that no further sawing or cutting is required. With dowel and hole pairs on each side of the connecting surface, pieces are easily assembled merely by pushing dowels into matching holes for attachment.

In addition to contemplating various structures and openings, as well as various ways the pieces of kits 170 and 970 can be assembled together, the invention contemplates various ways of securing an opening frame kit to an opening and/or installed window or door, etc.

Figure 4:
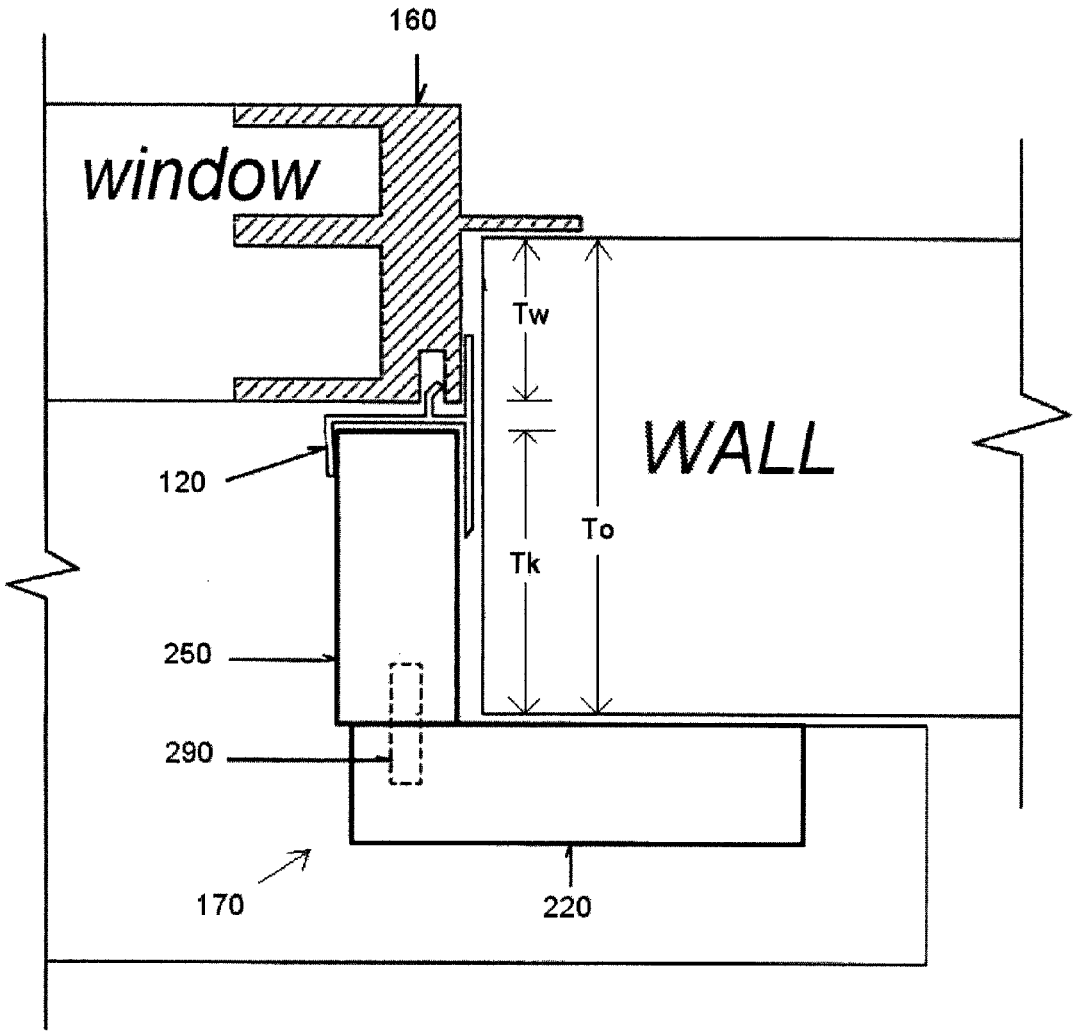
FIG. 4 is the enlarged top view of the middle cross section of a installed window trim kit shown in FIG. 1.

FIG. 4 shows one example according to the invention. In particular, it shows an enlarged top view taken along cross-section 4-4 of FIG. 2. The trim 170 is installed to a window perimeter slot 120, which is itself attached to a window frame 160. There are several forms of window perimeter slots 120 that can be used, and the particular one shown here is a vinyl extrusion manufactured by EZ Trim Kit, LLC. However, this example is provided for illustration purposes, and the invention is not limited to this example. As shown in FIG. 4, profile 220 is attached to the jamb extender 250 with dowel and hole 290. The U-shape of slot 120 allows the jamb extender 250 to snap and lock into the slot 120 with a friction fit. It should be appreciated that glue or other adhesives can also be used to reinforce the friction fit.

Figure 5:
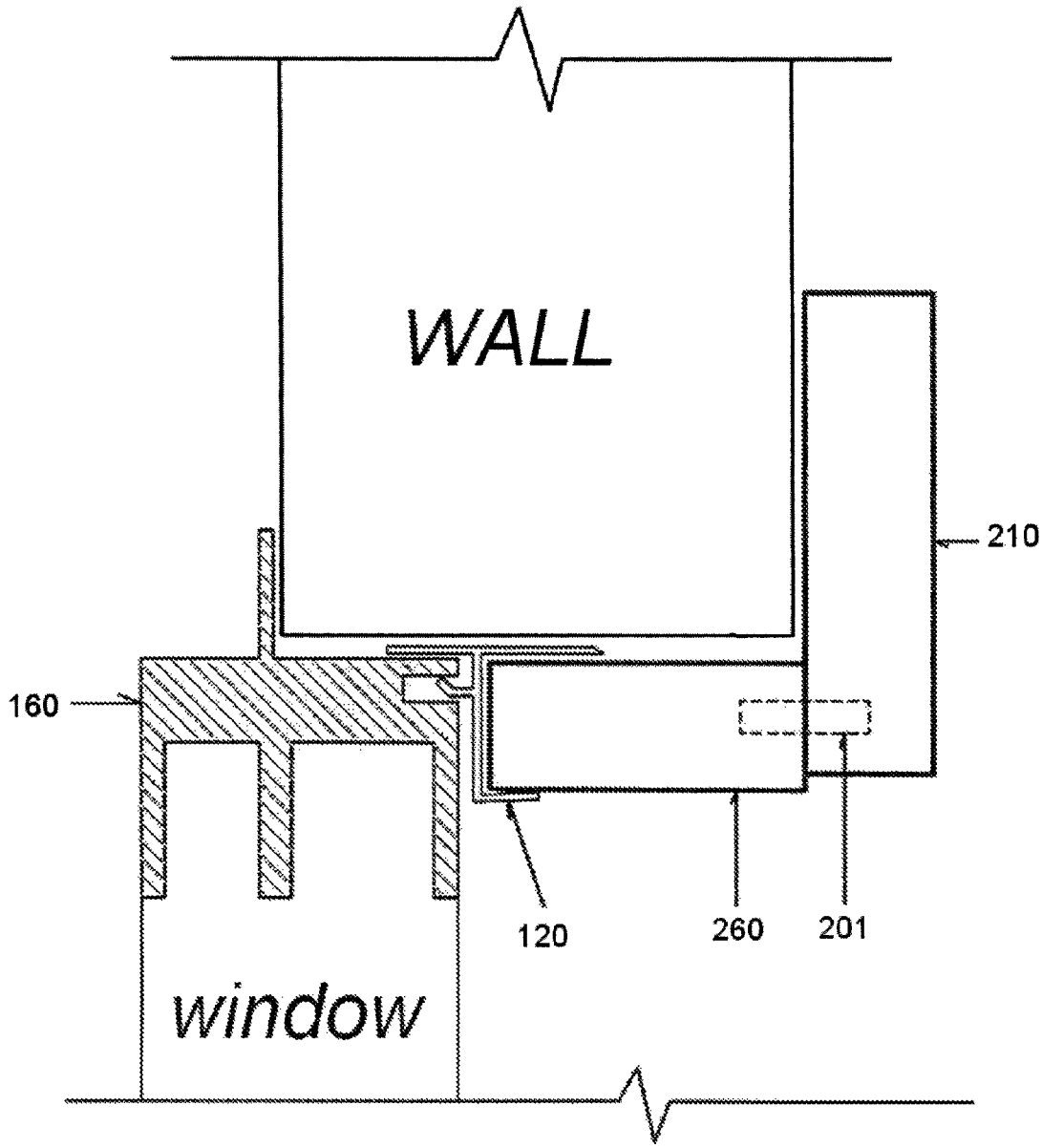
FIG. 5 is the enlarged side view of the upper-left corner of a installed window trim kit; shown in FIG. 1.

FIG. 5 shows an enlarged side view taken along cross-section 5-5 in FIG. 2. As shown, head trim 210 is attached to the head jamb extender 260 with dowels and holes 201. The U-shape of slot 120 allows the head jamb extender 260 to snap and lock into the slot 120 with a friction fit.

Figure 6:
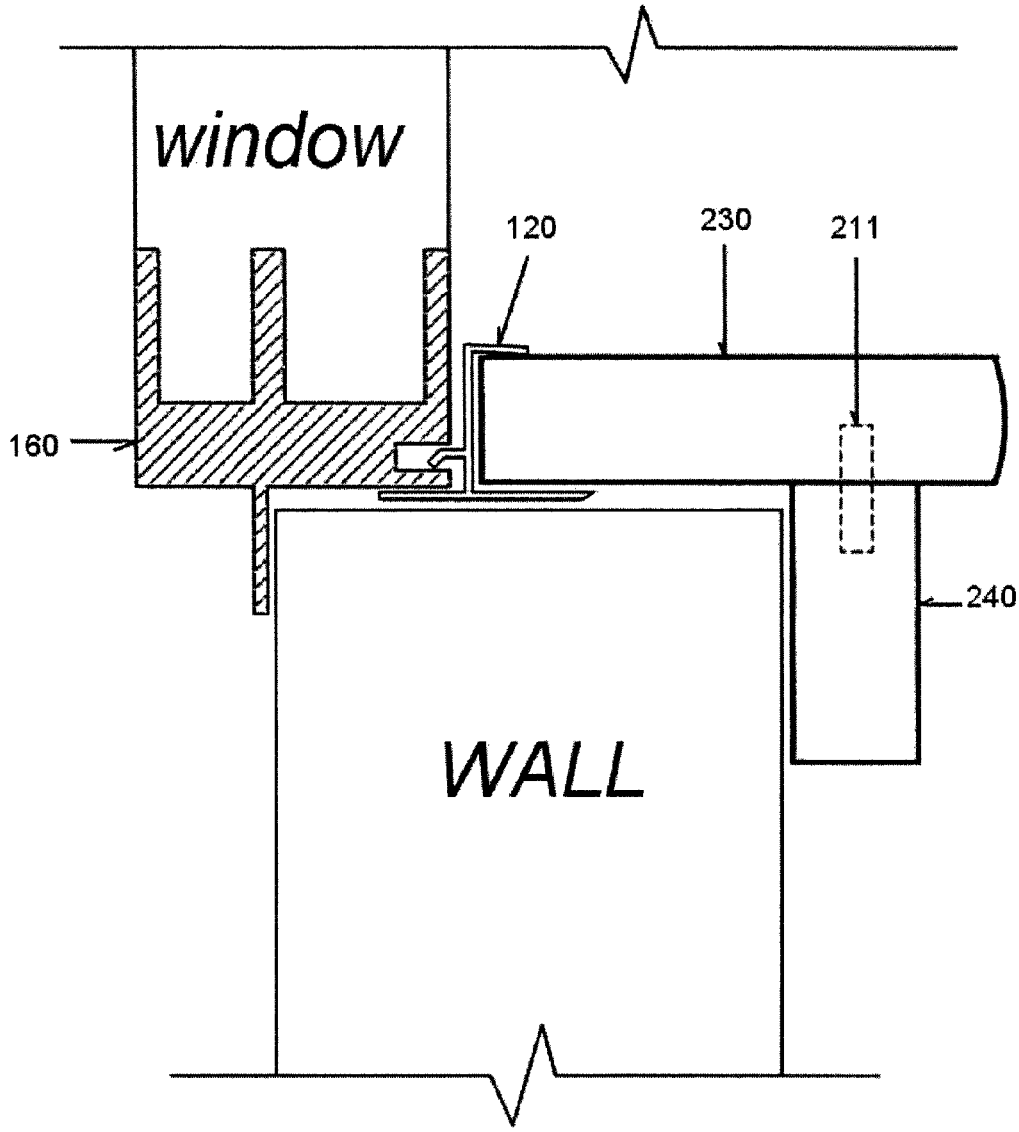
FIG. 6 is the enlarged side view of the lower-left corner of a installed window trim kit; shown in FIG. 1.

FIG. 6 shows an enlarged side view taken along cross-section 6-6 of FIG. 2. The trim sill 230 is attached to the trim apron 240 with dowel and holes 211. Again, the U-shape of slot 120 allows the trim sill 230 to snap and lock to the slot 120 with a friction fit.

It should be noted that slot 120 need not extend the entire interior lengths of the window 160. For example, several separate pieces of vinyl can be used instead of one continuous piece. Moreover, the one or more pieces of slot 120 can be screwed onto window 160 for additional rigidity.

Figure 7:
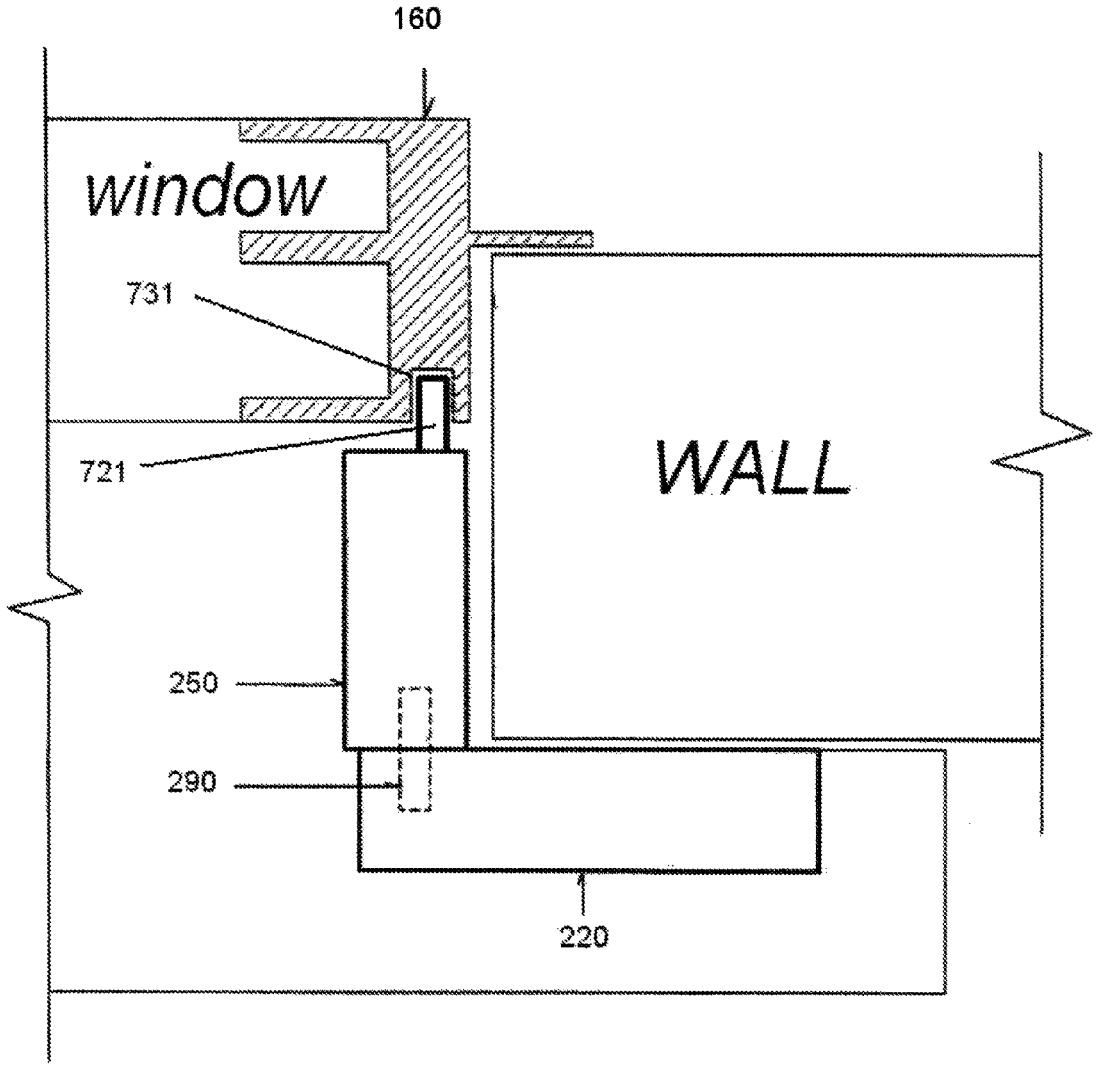
FIG. 7 is an enlarged top view of the middle cross section of a installed window trim kit with tongues and grooves according to another example of the invention.

As mentioned above, additionally or alternatively to window perimeter slots 120, other materials can be used to attach the window trim assembly 170 to window frame 160. One example shown in FIG. 7 is a variation of FIG. 4. In this example, jamb extender 250' includes a tongue 721 that engages with a groove 731 of window frame 160. In this embodiment, window frame 160 can be a casement type window from Andersen, though various other types of windows are possible. The tongue 721 is integrally formed or machined in extender 250' and is about ¼" wide and about ½', long. It is dimensioned so as to engage with groove 731 with a friction fit. It should be noted that glue or other adhesive can be used to reinforce the friction fit.

Figure 8:
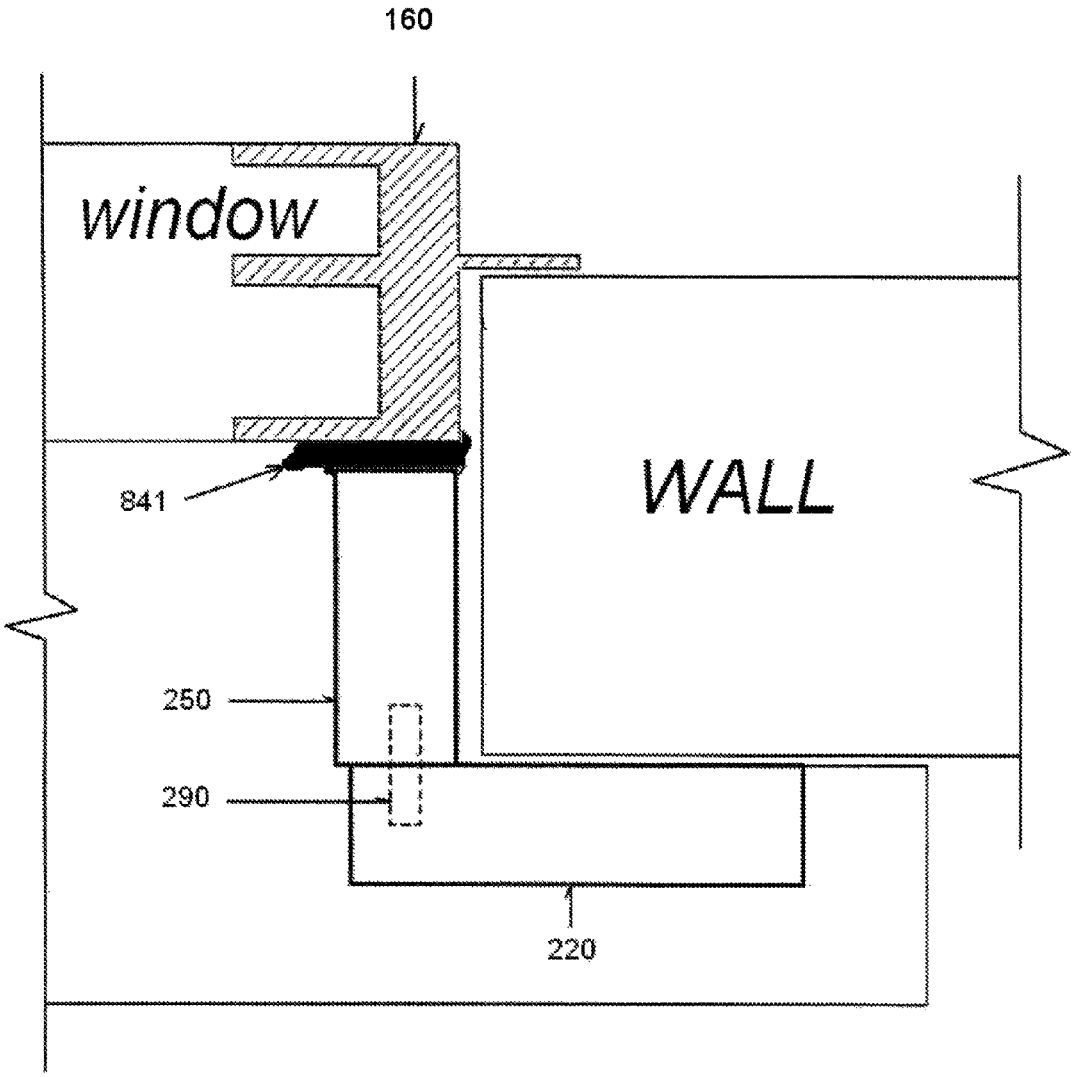
FIG. 8 is an enlarged top view of the middle cross section of an installed window trim kit using adhesive materials according to another example of the invention.

FIG. 8 is another example alternative to using slots 120. In this example embodiment, window trim kit 170 is glued or otherwise adhered to window frame 160 with adhesive material 841. The amount and type of adhesive material that is used can depend on the materials comprising window frame 160 and kit 170. In an example where kit 170 is comprised of wood, glue or epoxy may be used. Silicone, epoxy or other materials may be used where window 160 or kit 170 is comprised of vinyl. As shown in this example, the surface of jamb extender 250 is substantially flat and flush with a corresponding surface of window 160.

In addition to above described alternative embodiments, optional parts such as decorative sill trim, decorative corner pieces (e.g. cornices, rosettes), curtain rods or valances, closet shelves and poles can be further attached and/or integrally formed in pieces provided in kit 170 depending upon needs and preferences.

Figure 15A:
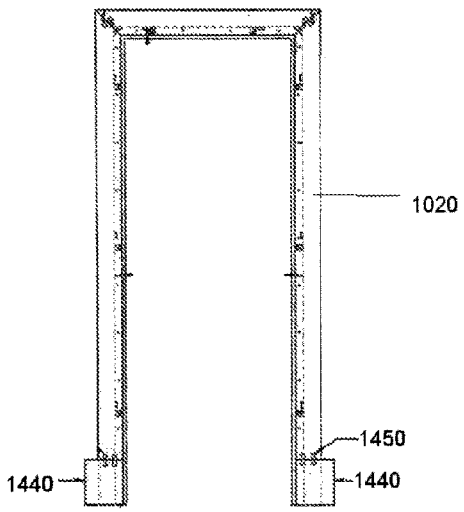
FIG. 15*a* is an alternative of the door trim kit shown in FIG. 9.

FIG. 15*a* shows an alternative of door trim 970 where decorative blocks 1440 are added to the bottom by connecting one side to the end of profile 1020 using dovetails 1450 and/or dowels/holes.

Figure 15B:
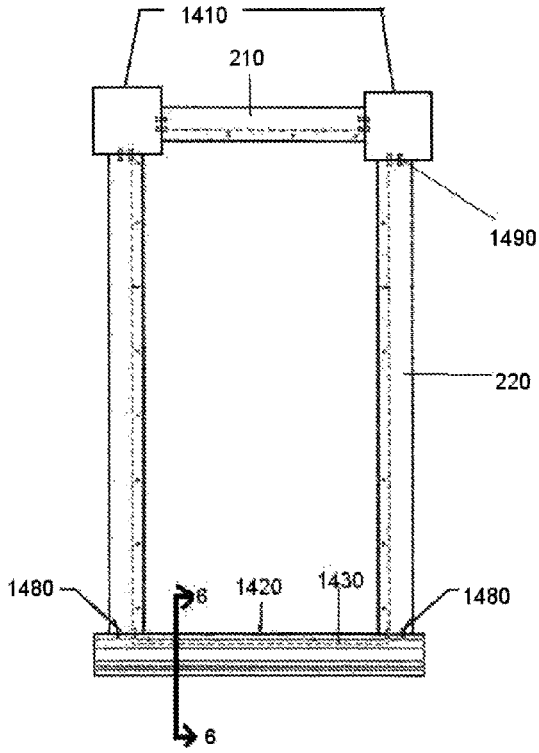
FIG. 15*b* is an alternative of the window trim kit shown in FIG. 1.

FIG. 15*b* shows another alternative of the window trim example 170 where decorative corner pieces 1410 (i.e. cornices) and sill trim 1420 are added to the kit. One side of the corner pieces is connected directly to the side trim 220 using dovetails 1490, and another side to the head trim 210. Sill trim 1420 in this case is connected to a sill trim extender 1430 using dovetails 1490 and pairs of dowel and hole 1480.

Figure 16:
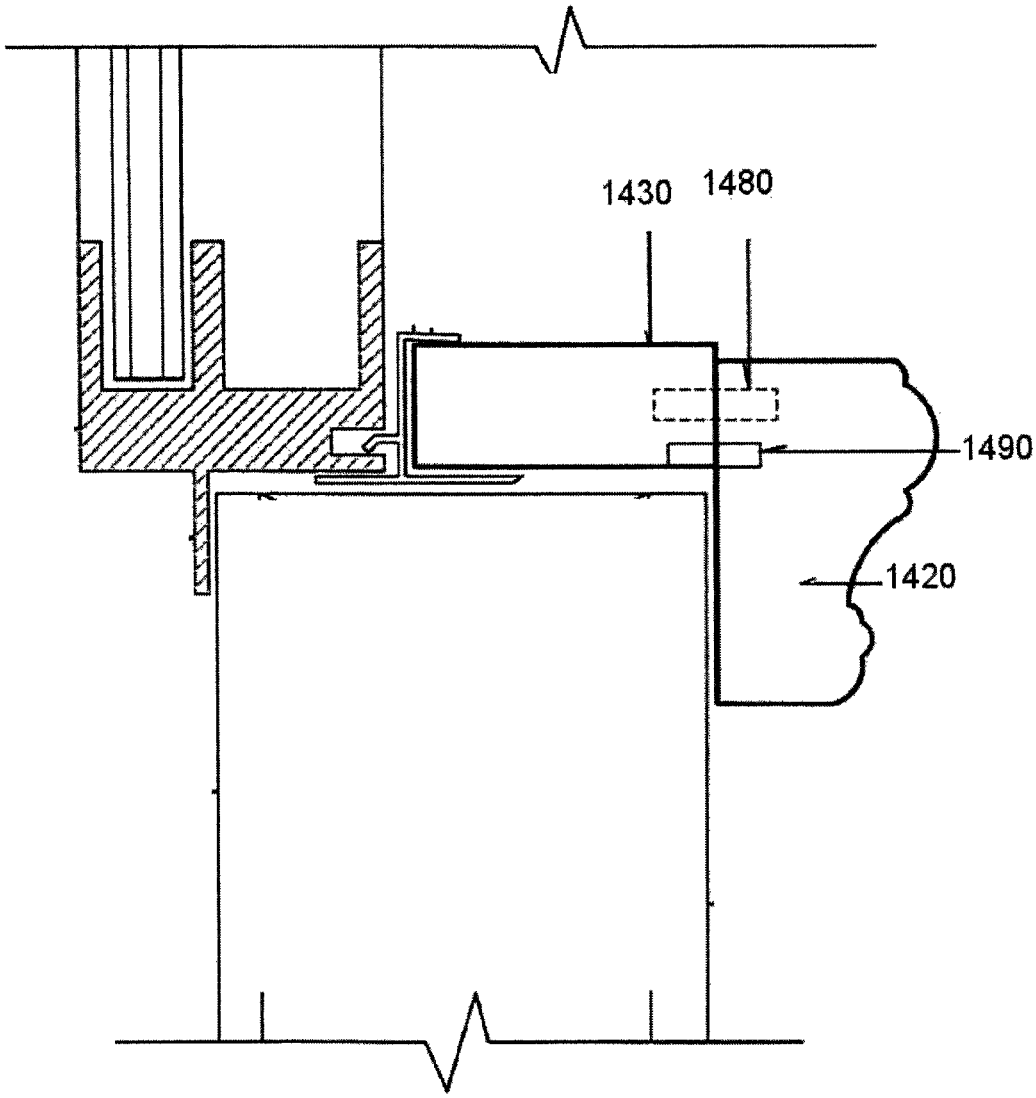
FIG. 16 is the enlarged side view of the lower-left corner of the installed window trim kit shown in FIG. 15*b*.

FIG. 16 shows an enlarged side view taken along cross-section 6-6 in FIG. 15*b*. The trim sill 1420 is attached to the trim sill extender 1430 with dovetails 1490 and dowels and holes 1480.

According to a still further aspect of the invention mentioned above, all the pieces of kit 170 are pre-sized, cut and finished for a given window opening and type of window. It is also possible to machine and finish the pieces to match a desired architectural style, or pre-existing and other types of molding in a building such as baseboards and crown molding. It should be appreciated that an advantage of the invention is that considerable economies of scale can be achieved by mass producing kits for a large number of buildings, such as housing developments, which may all have similar architectural and/or interior styles. The invention allows machinery, tools and materials for creating kits to be centralized, and then the kits can be easily shipped to a site and assembled easily on site, thereby greatly reducing costs and improving quality.

Figure 3:
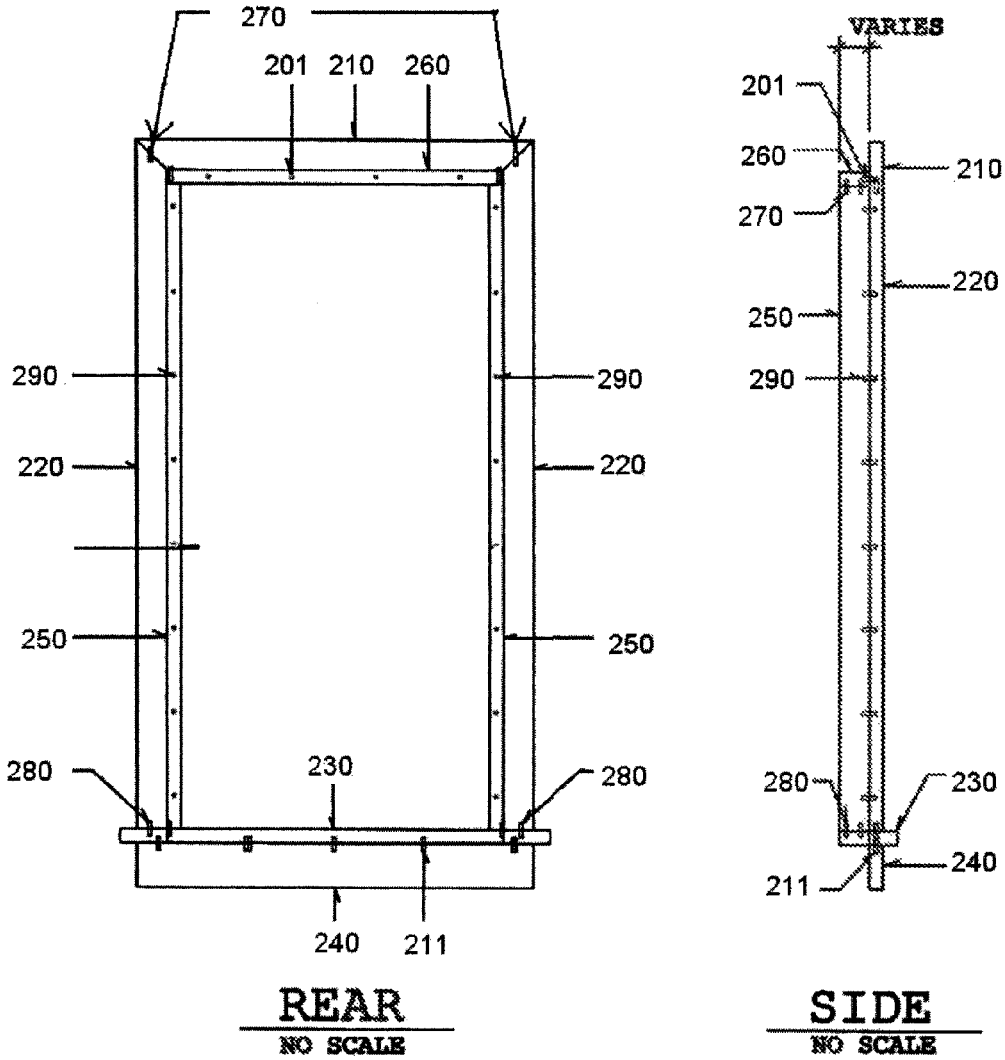
FIG. 3 is the rear and side view of the assembled window trim shown in FIG. 1.

An example method of preparing a kit 170 for a given window opening and type of window is described in more detail herein, and with reference to FIGS. 2 to 4. For example, assume that a standard window opening has a height $H_O$, a width $W_O$ and a thickness (e.g. wall thickness) $T_O$. Most window manufacturers provide windows that have combinations of height and width to accommodate almost any standard window opening and there is generally no need to adjust the height and width of the kit to account for a given opening. Accordingly, as shown in FIG. 2, the length of all pieces 210, 220, 240, 250 and 260 in the kit can be determined from the size of the opening in a straightforward manner from the dimensions $H_O$ and $W_O$.

However, as further shown in FIG. 4, various manufacturers can provide various thicknesses $T_W$ corresponding to the amount that the window extends from the exterior of a wall towards the interior of the wall in the window opening. Accordingly, this measurement is known and/or can be predetermined for any given manufacturer, and the width $T_K$ of extender pieces 250 and 260 can be determined as approximately $T_K=T_O-T_W$. It should be apparent that depending on the type of extrusion or connector material such as slots 120, that some variation may need to be used to allow the profile pieces 210 and 220 to be flush with the interior wall, but in many cases this can be ignored. It should be further noted that the width of sill 230 is at least $T_K$, plus an additional amount depending on a desired sill depth.

Once the dimensions and shapes of kit 170 are computed for a desired window opening and window manufactured, the pieces of kit 170 are designed for a desired ornamental appearance and pieces are manufactured in several steps: machine dissecting big pieces of wood into several wood pieces according to the design, drilling holes in the pieces at desired separation as described above, providing dowels for each of the holes, machining, painting or staining the pieces to a desired finish, and packaging the kit. Unlike conventional window trimming, the mass-production of pre-fabricated trim kits as allowed by the invention not only lowers the manufacturing cost substantially but also ensures quality consistency.

Although the present invention is illustrated as practicing upon a double-hung window, principles of invention could be extended to any shape of openings, not limited to square or rectangle, and furthermore, principles of invention could be extended to any type of building openings including any form of window or door, such as a vent, skylight, fireplace surrounding, closet door, cabinets, etc.

Moreover, it should be apparent that the principles of the invention can be readily extended to other types of molding that are commonly used in constructing or renovating buildings such as offices and homes. For example, baseboards and crown molding can be mass-machined and cut to desired lengths and sizes of rooms, shipped to sites, and assembled on site using dowels and dovetails. Honches can also be used and various types of corners and other pieces can be provided to fill gaps and connect corners, for example.

Although the present invention has been particularly described with reference to the preferred embodiments thereof, it should be readily apparent to those of ordinary skill in the art that changes and modifications in the form and details may be made without departing from the spirit and scope of the invention. It is intended that the appended claims encompass such changes and modifications.

What is claimed is:

1. A kit for framing an opening in a building, wherein the opening is for a door, the opening having a frame portion, a first side and a second side, the kit comprising a plurality of pieces, the plurality of pieces comprising:

a head trim to abut the first side;

a pair of profiles to abut the first side, the head trim couplable with the pair of profiles with a friction fit;

a pair of side jambs to abut the frame portion, the side jambs respectively couplable with the pair of profiles with a friction fit;

a head jamb to abut the frame portion, the head jamb couplable with the head trim with a friction fit, and the head jamb couplable with the side jambs with a friction fit;

a head trim to abut the second side, the head trim couplable with the head jamb with a friction fit;

a pair of profiles to abut the second side, the head trim couplable with the pair of profiles with a friction fit, the pair of profiles respectively couplable with the pair of side jambs with a friction fit, wherein at least one of the plurality of pieces includes:

a tongue adapted to insert into a groove in the opening; and an outer flange that extends in a common direction with the tongue and spaced from the tongue by an amount corresponding to a portion of the opening between the groove and a surface of the door frame, wherein the spaced amount is adapted to cause the at least one piece to engage with the portion of the door frame with a friction fit when the tongue is inserted into the groove and the outer flange simultaneously presses against the exterior surface.

2. The kit of claim 1, wherein the head trims and pairs of profiles are each assembled together near the building and wherein the head jam and the pair of side jambs are assembled together near the building.

3. The kit of claim 1, further comprising a decorative block couplable to one of the pair of profiles with a friction fit.

4. The kit of claim 1, wherein each of the side jambs comprises a first side jamb piece and a second side jamb piece, and wherein the first side jamb piece is adjustably coupled to the second side jamb piece.

5. A kit for framing an opening in a building, wherein the opening is for a door, the opening having a frame portion, a first side and a second side, the kit comprising:

a plurality of pieces to form a first door casing, the first door casing to abut the first side of the opening, wherein the plurality of pieces of the first door casing include:

a head trim for framing a top portion of the opening and to abut the first side; and a pair of profiles for framing side portions of the opening and to abut the first side, the head trim couplable with the pair of profiles with a friction fit; and a plurality of pieces to form a door jamb to abut the frame portion, wherein the first door casing is couplable to the door jamb with a friction fit, and wherein the plurality of pieces of the door jamb include:

a pair of side jambs for framing the side portions of the opening and to abut the frame portion, the side jambs respectively coupling with the pair of profiles with the friction fit; and a head jamb for framing the top portion of the opening and to abut the frame portion, the head jamb couplable with the head trim with the friction fit, the head jamb couplable with the side jambs with a friction fit, wherein at least one of the plurality of pieces includes:

a tongue adapted to insert into a groove in the opening; and an outer flange that extends in a common direction with the tongue and spaced from the tongue by an amount corresponding to a portion of the opening between the groove and a surface of the door frame, wherein the spaced amount is adapted to cause the at least one piece to engage with the portion of the door frame with a friction fit when the tongue is inserted into the groove and the outer flange simultaneously presses against the exterior surface.

6. A kit according to claim 5, further comprising a plurality of pieces to form a second door casing to abut the second side of the opening and couplable to the door jamb with a friction fit.

7. A kit according to claim 5, further comprising dowels and holes for coupling the plurality of pieces together.

8. A kit according to claim 5, further comprising dovetail fasteners for coupling the plurality of pieces together.

9. A kit according to claim 5, further comprising a door stop coupled to the side jambs and the head jamb.

10. A kit according to claim 5, further comprising:

a pair of block pieces that couple to the profiles and abut a floor portion of the first side.

11. A kit according to claim 5, wherein the plurality of pieces of the second door casing include:

a head trim for framing a top portion of the opening and to abut the second side; and a pair of profiles for framing side portions of the opening and to abut the second side.

12. A kit according to claim 5, wherein the plurality of pieces of the first door casing and the plurality of pieces of the door jamb can be assembled together in the opening by hand.

13. A kit according to claim 5, wherein each of the plurality of pieces is pre-cut and pre-finished for the opening.

14. The kit of claim 5, further comprising a decorative block couplable to one of the pair of profiles with a friction fit.

15. The kit of claim 5, wherein each of the side jambs comprises a first side jamb piece and a second side jamb piece, and wherein the first side jamb piece is adjustably coupled to the second side jamb piece.

* * * * *